US007161568B2

(12) United States Patent
Park et al.

(10) Patent No.: US 7,161,568 B2
(45) Date of Patent: Jan. 9, 2007

(54) METHOD OF DRIVING LIQUID CRYSTAL DISPLAY

(75) Inventors: Jong Jin Park, Seoul (KR); Hyeon Ho Son, Anyang-shi (KR); Ku Hyun Park, Anyang-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 750 days.

(21) Appl. No.: 09/893,994

(22) Filed: Jun. 29, 2001

(65) Prior Publication Data

US 2002/0084959 A1 Jul. 4, 2002

(30) Foreign Application Priority Data

Dec. 29, 2000 (KR) ..... 2000-85393

(51) Int. Cl.
*G09G 3/36* (2006.01)

(52) U.S. Cl. ..... 345/87; 345/89; 345/94; 345/99; 345/204; 345/208; 345/212; 345/213

(58) Field of Classification Search ..... 345/87–89, 345/95–100, 208, 211–213, 127, 204
See application file for complete search history.

(56) References Cited

U.S. PATENT DOCUMENTS

| | | | | |
|---|---|---|---|---|
| 5,206,634 | A * | 4/1993 | Matsumoto et al. | 340/784 |
| 5,365,284 | A * | 11/1994 | Matsumoto et al. | 348/793 |
| 5,844,538 | A * | 12/1998 | Shiraki et al. | 345/98 |
| 6,181,317 | B1 * | 1/2001 | Taguchi et al. | 345/132 |
| 6,229,516 | B1 * | 5/2001 | Kim et al. | 345/103 |
| 6,545,653 | B1 * | 4/2003 | Takahara et al. | 345/87 |
| 6,744,417 | B1 * | 6/2004 | Yamashita et al. | 345/92 |
| 6,819,311 | B1 * | 11/2004 | Nose et al. | 345/100 |
| 2002/0084964 | A1 * | 7/2002 | Park et al. | |

* cited by examiner

*Primary Examiner*—Richard Hjerpe
*Assistant Examiner*—Jennifer T. Nguyen
(74) *Attorney, Agent, or Firm*—Morgan, Lewis & Buckius, LLP

(57) ABSTRACT

A method of driving a liquid crystal display that is adaptive for improving a picture quality.

In the method, a clock pulse is applied to a gate driver. First to third gate output enable signals are applied to the gate driver. A scanning pulse is applied to two gate lines during one period of the clock pulse.

22 Claims, 12 Drawing Sheets

METHOD OF DRIVING LIQUID CRYSTAL DISPLAY

This application claims the benefit of Korean Application No. P 2000-85393, filed in Korea on Dec. 29, 2000, which is hereby incorporated by reference.

BACKGROUND OF THE INVENTION

1. Field of the Invention

This invention relates to a technique of driving a liquid crystal display, and more particularly to a method of driving a liquid crystal display that is adaptive for improving a picture quality.

2. Discussion of the Related Art

Generally, an active matrix liquid crystal display (LCD) controls a light transmissivity of a liquid crystal using an electric field applied to the liquid crystal. To this end, as shown in FIG. 1, the active matrix LCD includes a liquid crystal display panel 2 having liquid crystal cells arranged between two sheets of transparent substrates in a matrix form, a gate driver 6 connected to gate lines GL1 to GLm of the liquid crystal display panel 2, and a data driver 4 connected to data lines DL1 to DLn of the liquid crystal display panel 2.

The gate driver 6 sequentially applies a scanning pulse to m gate lines GL1 to GLm to drive thin film transistors (TFTs) connected to the corresponding gate line. The data driver 4 supplies a data corresponding to a brightness value of a video data to n data lines DL1 to DLn in synchronization with the scanning pulses that are sequentially applied to the gate lines GL1 to GLm.

More specifically, the conventional LCD sequentially turns on and off the gate lines GL1 to GLm during one frame and supplies a data corresponding to the turned-on gate lines GL1 to GLm to the data lines DL1 to DLn, thereby displaying a picture.

FIG. 2 shows driving waveforms of the conventional gate driver and the conventional data driver. Referring to FIG. 2, the gate driver 6 receives a clock signal (e.g., 22 μs in the case of XGA) and a gate output enable (GOE) signal from an external control circuit (not shown). The gate driver 6 supplied with the clock signal and the GOE signal sequentially applies a scanning pulse SP to the 1st to mth gate lines GL1 to GLm in synchronization with the clock signal. The data driver 4 applies picture data D to the data lines DL1 to DLn in synchronization with the scanning pulse SP that is sequentially applied to the gate lines GL1 to GLm.

The GOE signal is divided into first to third GOE signals GOE1 to GOE3. FIG. 3 schematically shows a relationship between the GOE signals and the gate lines. As shown in FIG. 3, the first gate output enable signal GOE1 is applied to the (3i+1)th gate lines GL1, GL4, etc. (where i is a non-negative integer). The second gate output enable signal GOE2 is applied to the (3i+2)th gate lines GL2, GL5, etc. The third gate output enable signal GOE3 is applied to the (3i+3)th gate lines GL3, GL6, etc.

The gate lines GL1 to GLm remain at, or are forced to return to, a low state when the first to third gate output enable signals GOE1 to GOE3 assume a high state. For example, whenever the first gate output enable signal GOE1 assumes a high state, the (3i+1)th gate lines (GL1, GL4, . . . ) are at a low state.

Such gate output enable signals GOE1 to GOE3 are utilized to prevent a so-called crosstalk phenomenon between the adjacent pixel cells. The first gate output enable signal GOE1 is set at a high state between a scanning pulse SP applied to the (3i+1)th gate lines (GL1, GL4, . . . ) and a scanning pulse SP applied to the (3i+2)th gate lines (GL2, GL5, . . . ) to define the trailing edge of the gate pulse applied to (3i+1)th gate lines. In other words, the first gate output enable signal GOE1 is raised to a high state before a clock signal for applying the scanning pulse SP to the (3i+2)th gate lines (GL2, GL5, . . . ) is raised to a high state.

Accordingly, a point in time at which the scanning pulse SP applied to the (3i+1)th gate lines (GL1, GL4, . . . ) is changed into a low state is always set prior to a point in time at which the scanning pulse SP applied to the next (3i+2)th gate lines (GL2, GL5, . . . ) is raised to a high state, and is determined by the leading edge of the gate output enable signal GOE1. In other words, the scanning pulses SP, each of which originally spans from the leading edge of one clock pulse of the clock signal to the leading edge of the next clock pulse, are shaped to have a specific margin between two adjacent pulses. This way, it becomes possible to prevent the crosstalk phenomenon.

Similarly, the second gate output enable signal GOE2 is set at a high state between a scanning pulse SP applied to the (3i+2)th gate lines (GL2, GL5, . . . ) and a scanning pulse SP applied to the next (3i+3)th gate lines (GL3, GL6, . . . ). The third gate output enable signal GOE3 is set at a high state between a scanning pulse SP applied to the (3i+3)th gate lines (GL3, GL6, . . . ) and a scanning pulse SP applied to the next (3i+1)th gate lines (GL4, GL7, . . . ).

However, the conventional driving scheme described above suffers from the following drawbacks. As shown in FIG. 4, when a scanning pulse SP is applied to, for example, 295 the (m−10)th gate line GLm-10 by the gate driver 6, the liquid crystal display panel 2 is divided into a current frame 16 and a previous frame 18 separated by the (m−10)th gate line GLm-10. A picture to be displayed in the current frame is displayed in the current frame 16 while a picture that has been displayed in the previous frame is displayed in the previous frame 18.

Accordingly, if a moving picture shifts from the right side of the liquid crystal display panel 2 to the left side thereof, a moving picture 20 displayed in the current frame 16 and a moving picture 22 displayed in the previous frame 18 go amiss at the (m−10)th gate line GLm-10, as shown in FIG. 5A. This means that, to the observer, the previous data picture is seen to be interposed on the current data picture at portions 24 at which the moving picture 20 displayed in the current frame 16 has been shifted, as shown in FIG. 5B. When the previous data picture overlaps with the current data picture in this manner, a motion blur phenomenon is generated, and the picture quality of the liquid crystal display panel 2 accordingly deteriorates.

Each pixel of the liquid crystal display panel 2 can be represented by an equivalent circuit in FIG. 6. In FIG. 6, the pixel includes a thin film transistor (TFT) connected to a gate line GL, a data line DL, and a pixel electrode PE. The pixel also includes a liquid crystal cell Clc connected to a drain terminal of the TFT through the pixel electrode PE and a common voltage line CL carrying a common voltage Vcom. The pixel of the liquid crystal display panel 2 further includes a parasitic capacitor Cgs formed between the drain terminal of the TFT and the gate line GL, and a storage capacitor Cst formed between the drain terminal (and/or pixel electrode) of the TFT and a ground voltage source GND.

FIG. 7 shows a timing chart for the gate pulse SP and the voltage Vlc across the liquid crystal cell Cls. When a gate high voltage Vgh is applied to the gate line GL of the liquid crystal display panel 2, a data signal D is applied to the data line DL. As shown in FIG. 7, when the gate line GL is raised to the high voltage Vgh, the TFT is turned on, and the data pulse D applied to the data line DL is transferred to the drain side of the TFT (hence, to the pixel electrode PE). However, when the gate line GL returns to its low state (Vgl) at time t1, the voltage $V_D$ applied across the liquid crystal cell Clc undesirably drops by an amount ΔVp. This causes a brightness deterioration in the liquid crystal display panel 2, i.e., a picture quality deterioration. A voltage drop amount ΔVp in the voltage applied across the liquid crystal cell Cls is determined by the following equation:

$$\Delta Vp=(Cgs/(Cgs+Cst+Clc))*(Vgh-Vgl), \quad (1)$$

where Clc represents a capacitance of the liquid crystal cell, Vgh represents a gate high voltage value; and Vgl represents a gate low voltage value.

In the equation (1), the parasitic capacitor Cgs, the storage capacitor Cst, the gate high voltage value Vgh, and the gate low voltage value Vgl are fixed, whereas a capacitance value of the liquid crystal cell Clc is influenced by a displayed picture (i.e., the voltage applied across the liquid crystal cell in the previous frame). This is because the capacitance value Clc is proportional to the dielectric constant ϵ of the liquid crystal material, and the dielectric constant ϵ of the liquid crystal material varies depending upon the electric field applied thereto. If a stationary picture were always displayed on the liquid crystal display panel 2, then a voltage drop amount ΔVp of the data pulse would be predicted because a capacitance value of the liquid crystal cell Clc is constant. In such a case, the voltage drop amount ΔVp of the data pulse can be compensated, and accordingly, a picture quality deterioration in the liquid crystal display panel 2 can be prevented.

If a moving picture is displayed on the liquid crystal display panel 2, however, a voltage drop amount ΔVp of the data pulse cannot be predicted because the capacitance value of the liquid crystal cell Clc varies. Thus, the voltage drop amount ΔVp of the data signal applied to the liquid crystal cell Clc cannot be sufficiently compensated, and a picture quality deterioration results.

SUMMARY OF THE INVENTION

Accordingly, the present invention is directed to a method of driving a liquid crystal display that obviates one or more of the problems due to limitations and disadvantages of the related art.

An object of the present invention is to provide a method of driving a liquid crystal display that is adaptive for improving a picture quality.

Another object of the present invention is to provide a liquid crystal display device having an improved picture quality.

Additional features and advantages of the invention will be set forth in the description which follows, and in part will be apparent from the description, or may be learned by practice of the invention. The objectives and other advantages of the invention will be realized and attained by the scheme particularly pointed out in the written description and claims hereof as well as the appended drawings.

In order to achieve these and other objects of the invention, a method of driving a liquid crystal display according to one aspect of the present invention includes the steps of applying a clock pulse to a gate driver; applying first to third gate output enable signals to the gate driver; and applying a scanning pulse to two gate lines during one period of the clock pulse.

This driving method may be configured such that the data driver supplies the picture data to the data lines when the scanning pulse is applied to a first gate line of the two gate lines, and supplies a black data to the data lines when the scanning pulse is applied to a second gate line of the two gate lines. Alternatively, the driving method may be configured such that the data driver supplies a black data to the data lines when the scanning pulse is applied to a first gate line of the two gate lines, and supplies the picture data to the data lines when the scanning pulse is applied to a second gate line of the two gate lines.

The driving method may also be configured such that the first gate output enable signal is applied to the (3i+1)th gate lines (where i is a non-negative integer), the second gate output enable signal is applied to the (3i+2)th gate lines, and the third gate output enable signal is applied to the (3i+3)th gate lines.

The driving method may further include the steps of applying the scanning pulse to the (3i+1)th gate line during one period of the clock signal; applying the scanning pulse to the (3(i+k)+2)th gate line, which is thereby separated from the (3i+1)th gate line by 3k+1 gate lines, when the scanning pulse is applied to the (3i+1)th gate line, where k is a positive integer; setting the first gate output enable signal at a high state during one half of the one period of the clock signal when the scanning pulse is applied to the (3i+1)th gate line; and setting the second gate output enable signal at a high state during the other half of the one period of the clock signal when the scanning pulse is applied to the (3(i+k)+2)th gate line.

Alternatively, or in addition, the driving method may further include the steps of applying the scanning pulse to the (3i+2)th gate line during one period of the clock signal; applying the scanning pulse to the (3(i+k)+3)th gate line, which is thereby separated from the (3i+2)th gate line by 3k+1 gate lines, when the scanning pulse is applied to the (3i+2)th gate line, where k is a positive integer; setting the second gate output enable signal at a high state during one half of the one period of the clock signal when the scanning pulse is applied to the (3i+2)th gate line; and setting the third gate output enable signal at a high state during the other half of the one period of the clock signal when the scanning pulse is applied to the (3(i+k)+3)th gate line.

Alternatively, or in addition, the driving method may further include the steps of applying the scanning pulse to the (3i+3)th gate line during one period of the clock signal; applying the scanning pulse to the (3(i+k)+1)th gate line, which is thereby separated from the (3i+3)th gate line by 3k−2 gate lines, when the scanning pulse is applied to the (3i+3)th gate line, where k is a positive integer; setting the third gate output enable signal at a high state during one half of the one period of the clock signal when the scanning pulse is applied to the (3i+3)th gate line; and setting the first gate output enable signal at a high state during the other half of the one period of the clock signal when the scanning pulse is applied to the (3(i+k)+1)th gate line.

A method of driving a liquid crystal display according to another aspect of the present invention includes the steps of displaying a first picture on a liquid crystal display panel in the current frame; displaying a specific pattern of picture on the liquid crystal display panel on which said picture has been displayed; and displaying a second picture over said specific pattern of picture in the next frame. Here, the specific pattern of picture may be a black picture.

In another aspect, the present invention provides a liquid crystal display device, including a liquid crystal display panel having a plurality of gate lines and a plurality of data lines arranged substantially in a matrix form; a gate driver receiving a clock signal and connected to each of the plurality of gate lines, the gate driver internally and sequentially generating scanning pulses in synchronization with the clock signal, the gate driver receiving at least two gate output enable signals that respectively control different groups of the gate lines, wherein when a gate output enable signal is in an enabling state, the output of the scanning signal to the gate lines belonging to the corresponding group is enabled, and when a gate output enable signal is in a disable state, the output of the scanning signal to the gate lines belonging to the corresponding group is disabled, and wherein in one cycle of the clock signal, the gate driver generates a scanning pulse for a pair of gate lines that belong to different groups and processes the scanning pulse generated for the pair of gate lines with the corresponding gate output enable signals so as to divide the scanning pulse to two sequential pulses, the gate driver supplying one of the two sequential pulses to one of the pair of the gate lines and supplying the other one of the two sequential pulses to the other one of the pair of the gate lines; and a data driver connected to the plurality of data lines, the data driver supplying data signals to the plurality of data lines in synchronization with the one of the two sequential pulses, the data driver further supplying a reference signal to the plurality of data lines in synchronization with the other one of the two sequential pulses.

In a further aspect, the present invention provides a method for driving a liquid crystal display panel, including (a) selecting two gate lines that are separated by a predetermined number of gate lines; (b) providing picture signals to a row of pixels corresponding to one of the two selected gate lines; (c) providing a reference signal to a row of pixels corresponding to the other one of the two selected gates lines; (d) repeating steps (a) through (c) for different pairs of gate lines so that all rows of pixels are refreshed by corresponding picture signals in one frame; and (e) repeating steps (a) through (d) for each frame so that updated picture signals are provided to the pixels that bear the reference signal immediately prior to being updated.

It is to be understood that both the foregoing general description and the following detailed description are exemplary and explanatory, and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 8:
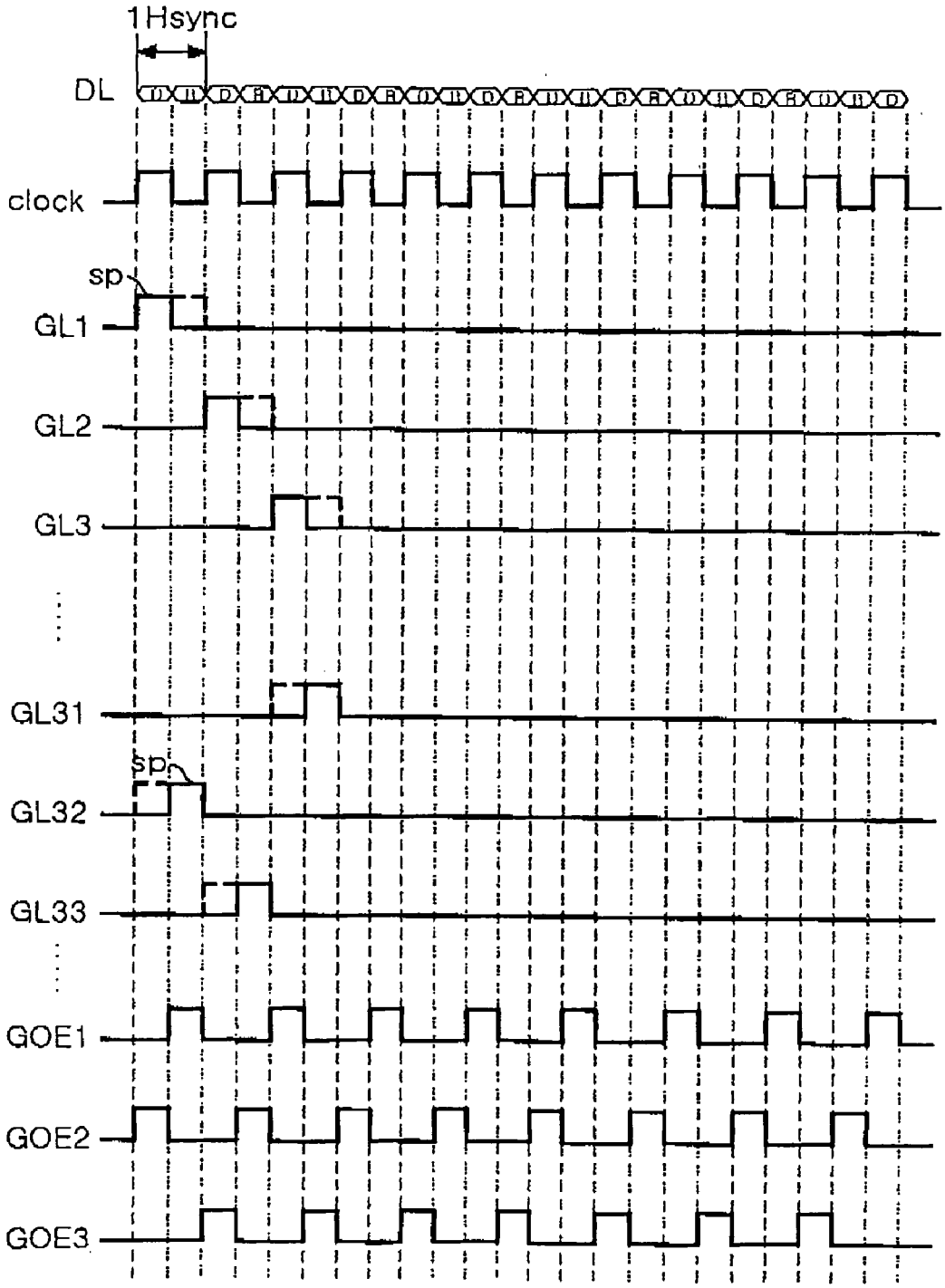
FIG. 8 shows driving waveforms of a gate driver and a data driver according to a first embodiment of the present invention.

FIG. 8 shows driving waveforms of the gate driver according to a first embodiment of the present invention. Referring to FIG. 8, the gate driver applies a scanning pulse SP to two gate lines GL during one period of a clock signal. Hereafter, an operation process will be described assuming that the process starts by applying the scanning pulse SP to the first gate line GL1 and the 32nd gate line GL32 in the same clock cycle (and subsequently to other gate lines as described below).

First, the gate driver is synchronized with a clock signal to generate a scanning pulse SP to be supplied with the first gate line GL1 and the 32nd gate line GL32. At that time, a second gate output enable signal GOE2 is set at a high state during a half period of the clock signal (e.g., during the first half period of the clock signal when the clock signal has a high state, as shown in FIG. 8). Accordingly, the 32nd gate line supplied with the second gate output enable signal GOE2 remains at a low state during the first half period of the clock signal at which the second gate output enable signal GOE2 maintains a high state. On the other hand, the first gate output enable signal GOE1 is set at a high state during the other half period of the clock signal (e.g., during the second half period of the clock signal when the clock signal has a low state, as shown in FIG. 8). Accordingly, the first gate line GL1 remains at a low state during the second half period of the clock signal at which the first gate output enable signal GOE1 maintains a high state. In other words, two gate lines GL1 and GL32 alternately assume a high state during one period of the clock signal.

Figure 9:
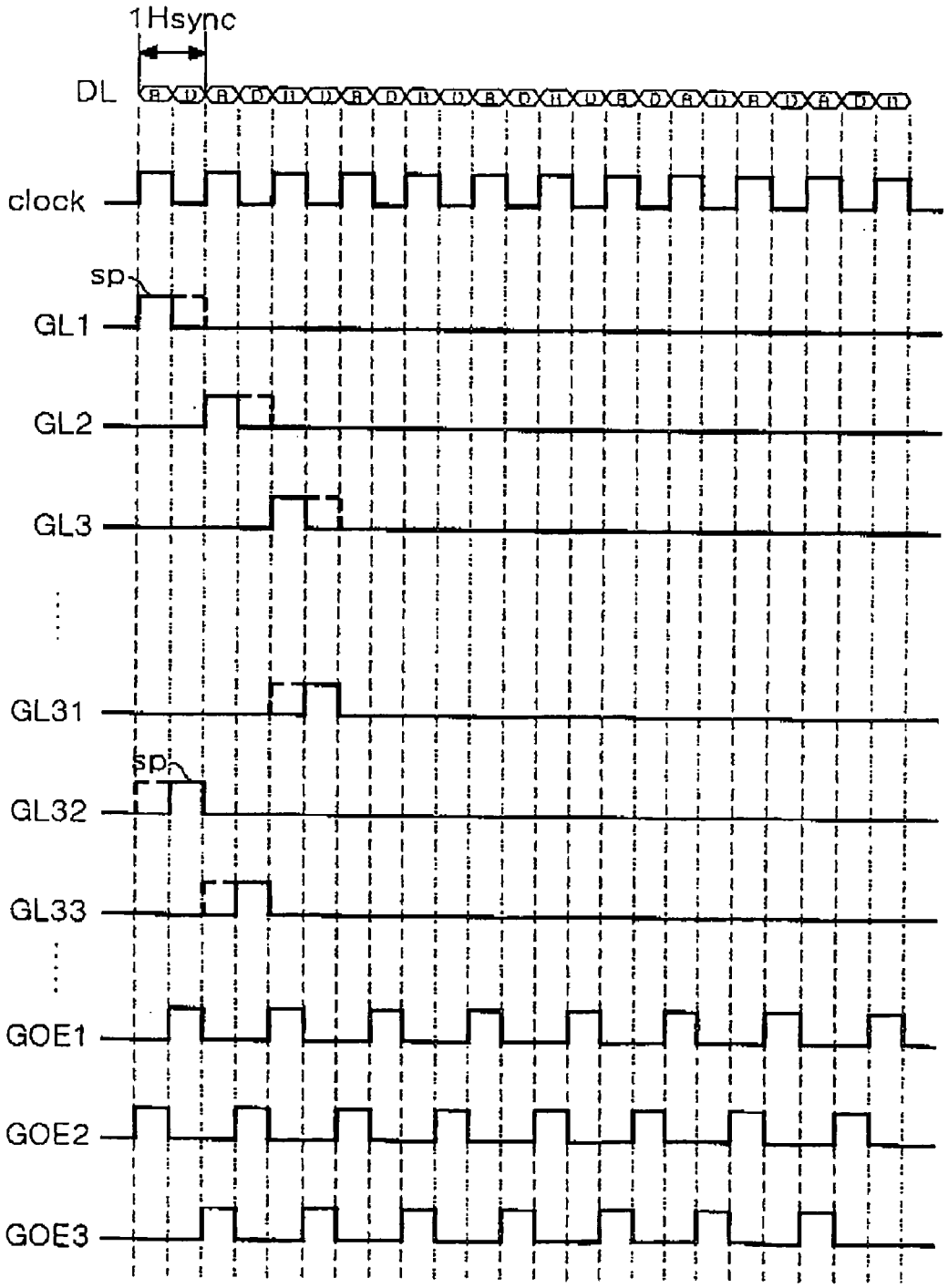
FIG. 9 shows another example of the driving waveforms according to the present invention.

The data driver supplies a picture data D to be displayed to the data lines DL when the scanning pulse SP that has been shaped by GOE1 is applied to the first gate line GL1 while supplying a reset data R corresponding to, for example, color black, to the data lines DL when scanning pulse SP that has been shaped by GOE2 is applied to the 32nd gate line GL32. In other words, the data driver sequentially supplies the picture data D and the reset data R to the data lines DL in that order during one period of a horizontal synchronous signal Hsync. To this end, a pulse signal having twice the frequency in the conventional art is applied to the data driver. Alternately, as shown in FIG. 9, the data driver may sequentially supply the reset data R and the picture data D to the data lines DL in that order during one period of the horizontal synchronous signal Hsync.

After a scanning pulse was applied to the first gate line GL1 and the 32nd gate line GL32, a scanning pulse SP is applied to the second gate line GL2 and the 33rd gate line GL33 during one period of the next clock. The data lines DL are supplied with the picture data D and the reset data R in synchronization with the scanning pulse SP.

More specifically, in the example of FIG. 8, a scanning pulse SP is synchronized with a clock signal to be sequentially applied to the (3i+1)th, (3i+2)th and (3i+3)th gate lines GL. After a scanning pulse SP is applied to the (3i+1)th gate line GL1 (and subsequently to GL4, GL7, . . . ), a scanning pulse SP is applied to the (3i+32)th gate line GL32 (and subsequently to GL35, GL38, . . . ) separated by a specific desired number of lines (31 lines in this case) within the same clock. Also, after a scanning pulse SP is applied to the (3i+2)th gate line GL2, (and subsequently to GL5, GL8, . . . ), a scanning pulse SP is applied to the (3i+33)th gate line GL33 (and subsequently to GL36, GL39, . . . ) separated by 31 lines within the same clock. Furthermore, after a scanning pulse SP was applied to the (3i+3)th gate line GL3 (and subsequently to GL6, GL9, . . . ), a scanning pulse SP is applied to the (3i+31)th gate line GL31 (and subsequently to GL34, GL37, . . . ) separated by a desired specified number of lines (29 lines in this case) within the same clock. This way, a scanning pulse SP, which originally spans over one clock cycle, is generated for two gate lines within one clock cycle, and is shaped in time in accordance with the first to third gate output enable signals GOE1 to GOE3 so that separate sequential pulses are actually applied to the two gate lines separated by the specified number of lines (31 and 29 in this example) within the same clock.

In the alternative, the specified number of lines between the two gate lines receiving the scanning pulses within the same clock cycle may be simply set to be the same number (31, for example) among three groups of gate lines ((3i+1)th, (3i+2)th, and (3i+3)th).

Figure 10:
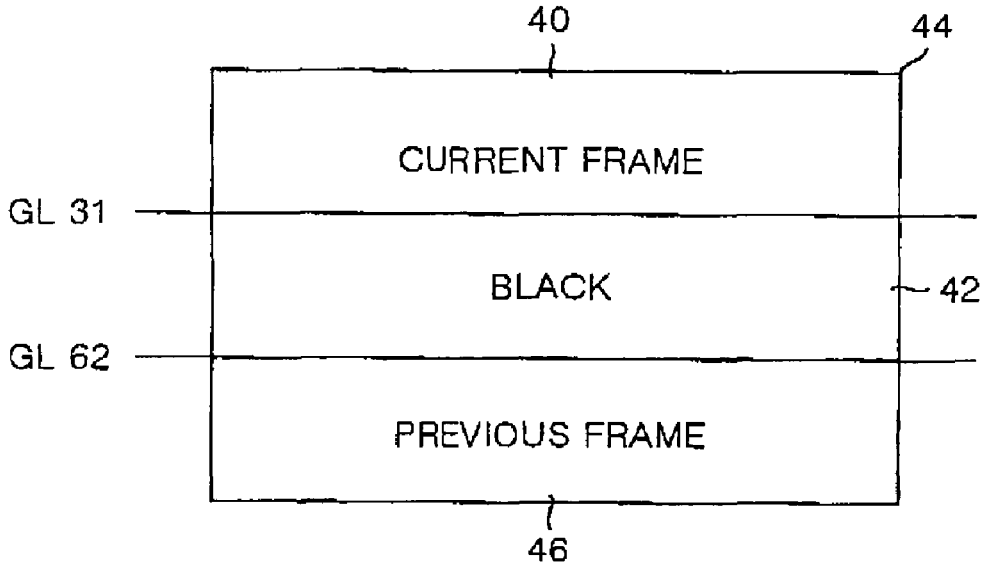
FIG. 10 illustrates a process of displaying a picture on the liquid crystal display panel by the driving waveforms shown in FIGS. 8 and 9.

In the driving scheme of FIG. 8, by the time a scanning pulse SP is about to be applied to the 31st gate line GL31 and the 62nd gate line GL62, a picture in the current frame 40 is displayed at the top side of the 31st gate line GL31 in a liquid crystal display panel 44 while a picture in the previous frame 46 is displayed at the lower side of the 62nd gate line GL62, as shown in FIG. 10.

At this point, a black picture 42 is displayed between the 31st gate line GL31 and the 62nd gate line GL62. In other words, the data driver has been supplying picture data D to the data lines DL while the gate driver has been supplying the scanning pulses SP to the 1st to 30th gate lines GL1 to GL30, and the data driver has been supplying reset data R (corresponding to black pixels) to the data lines DL while the gate driver has been supplying the scanning pulses SP to the 31st to 60th gate lines GL31 to GL60.

In the next clock cycle, a pixel row corresponding to the 31st gate line GL31, which has been written with the reset data R, is refreshed with the picture data D, and a pixel row corresponding to the 62nd gate line GL62 is refreshed with the reset data R. Thus, the reset data R in the 31st row of pixels is overwritten by the picture data D. Similarly in the subsequent clock cycles, the black picture at a pixel row corresponding to the 32nd gate line GL32 is refreshed with the picture data D. Accordingly, because the reset data R displays a black picture (in this example), a picture to be displayed on the liquid crystal display panel 44 is displayed over the black picture. In other words, in contrast to the conventional scheme in which a picture to be displayed in the current frame is displayed over a picture that has been displayed in the previous frame, in the present invention, the picture to be displayed in the current frame is always displayed over the black picture regardless of the previous picture. Accordingly, it is possible to prevent a motion blur phenomenon caused by an overlapping of a current picture with a previous picture.

Figure 1:
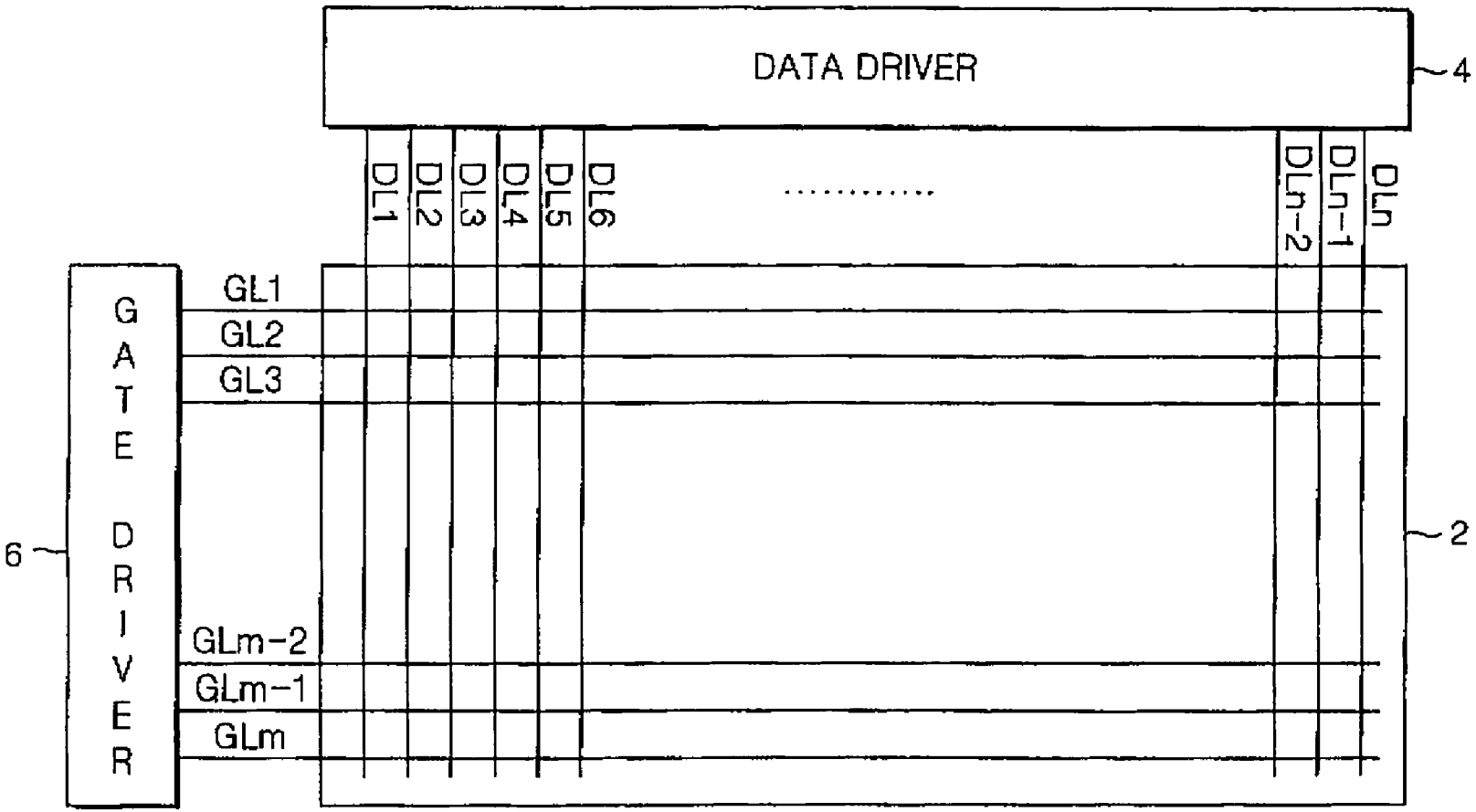
FIG. 1 is a schematic block diagram showing a configuration of a conventional liquid crystal display.
Figure 2:
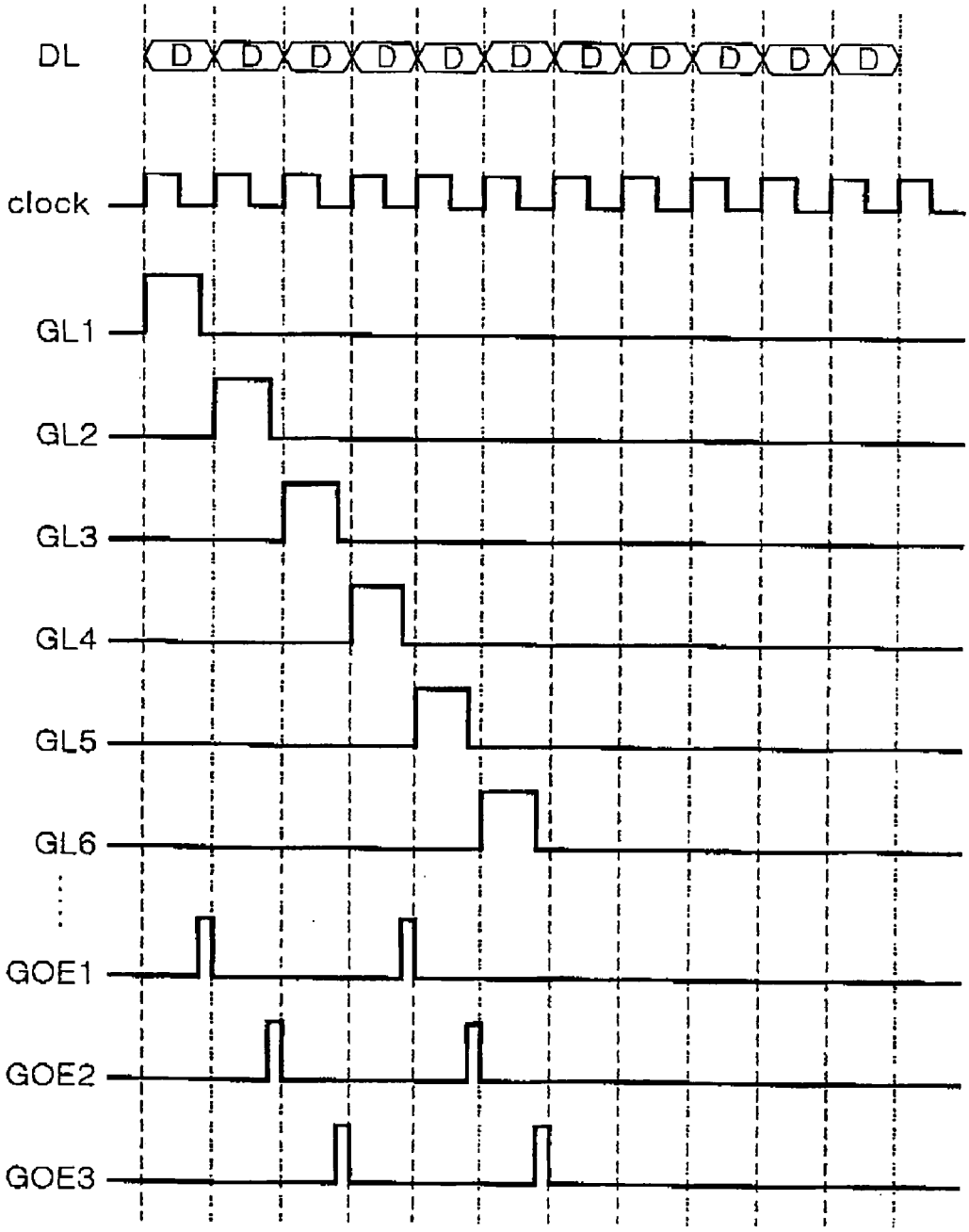
FIG. 2 shows driving waveforms of the gate driver in FIG. 1.
Figure 3:
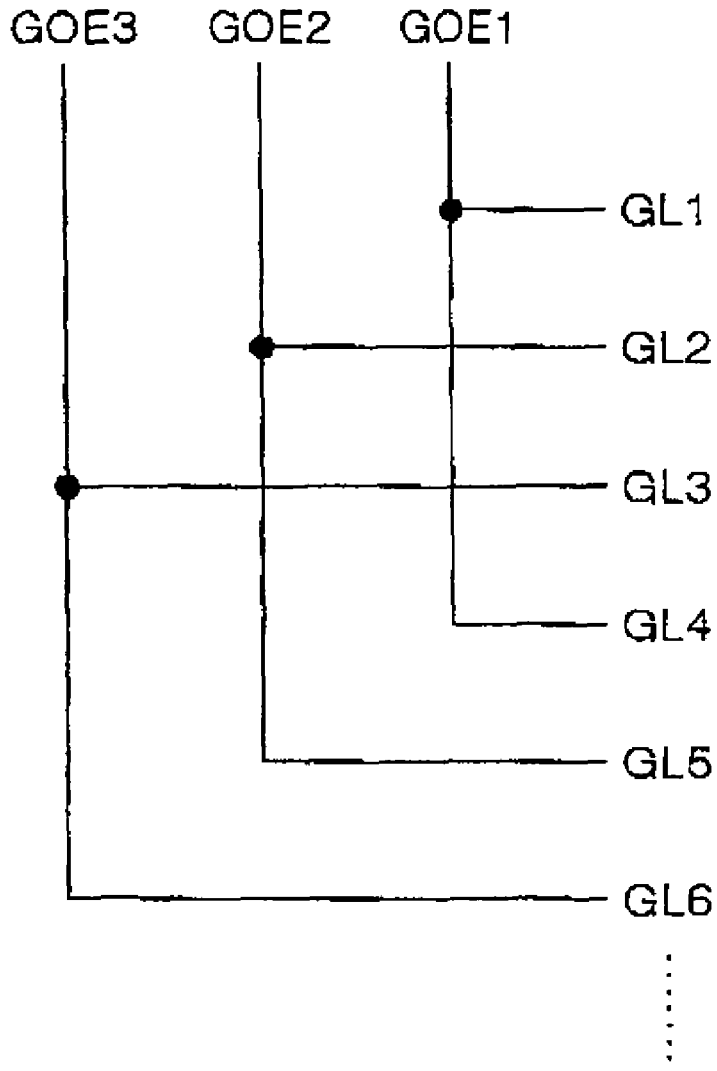
FIG. 3 schematically shows a relationship between gate lines and the gate output enable signals shown in FIG. 2.
Figure 4:
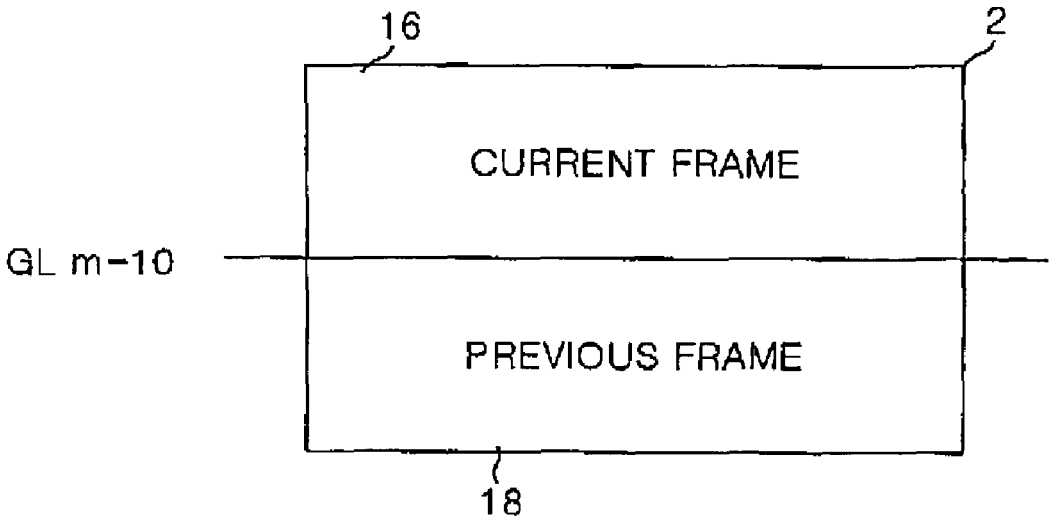
FIG. 4 illustrates a process of displaying a picture on the liquid crystal display panel of FIG. 1.
Figure 5A:
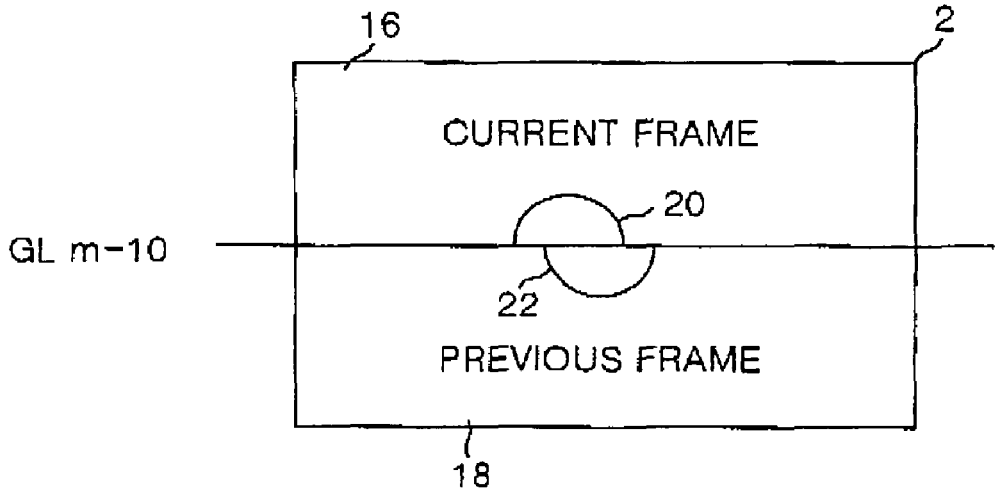
FIGS. 5A and 5B illustrate a process of displaying a moving picture on the liquid crystal display panel of FIG. 1.
Figure 5B:
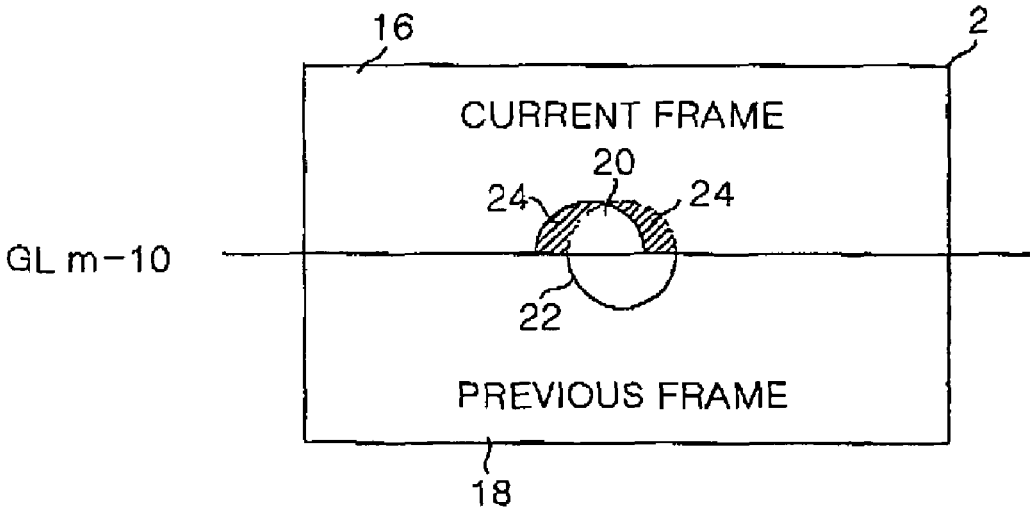
Figure 6:
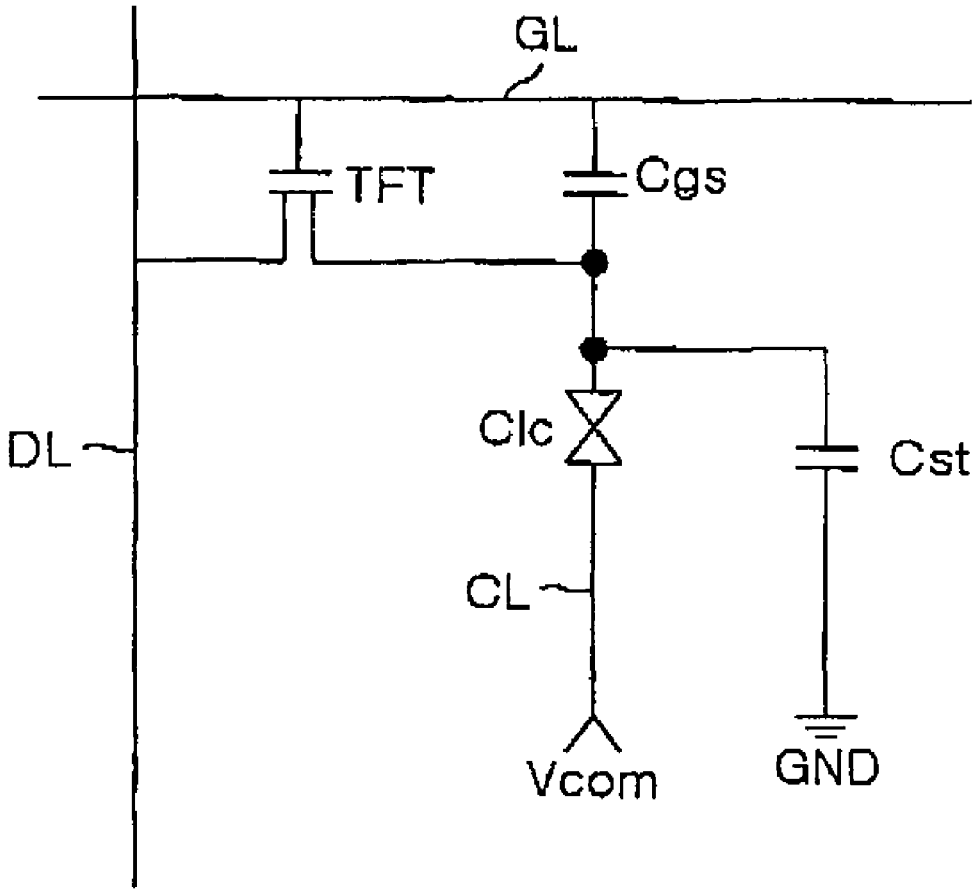
FIG. 6 is an equivalent circuit diagram of a pixel of the liquid crystal display panel of FIG. 1.
Figure 7:
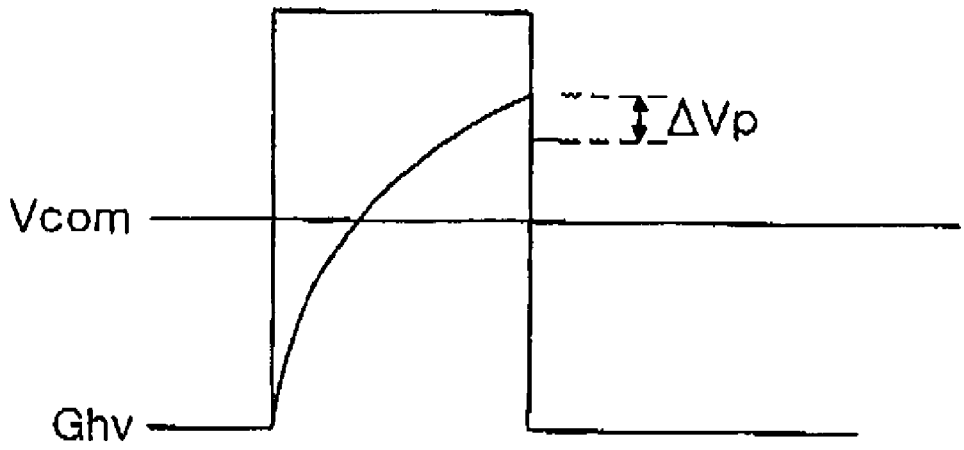
FIG. 7 is a waveform diagram showing a gate pulse and a data pulse applied to the liquid crystal cell shown in FIG. 6.

Furthermore, in the present invention, a capacitance value of the liquid crystal cell Clc in the above equation (1) is always fixed. Because a picture to be currently displayed is always displayed over a specific picture (a black picture in the above example), the capacitance value of the liquid crystal cell Clc is always fixed to a value corresponding to the black picture. Accordingly, a voltage drop amount $\Delta Vp$ of the data signal can be predicted, and compensation for the voltage drop amount $\Delta Vp$ of the data signal becomes possible. This can be achieved by, for example, adjusting the waveform and/or voltage level of Vcom (FIG. 6).

The specified separation between the two gate lines receiving the scanning pulse SP within the same clock cycle can be determined by various factors. For example, the separation may be varied depending upon the resolution and scale of the display panel.

In the driving scheme shown in FIG. 9, the picture data D is preceded by the reset data R. In this case also, because the picture data D written in the pixels are always overwritten by the black picture (reset data R) before being refreshed by the picture data for the next frame, effects similar to the example of FIG. 8 are achieved. In the case of FIG. 9, however, the specified separation between the two gate lines receiving the scanning pulses SP in the same clock cycle is typically set much larger than the example of FIG. 8 to provide for a sufficient display data retention time for the picture image within one frame.

Figure 11:
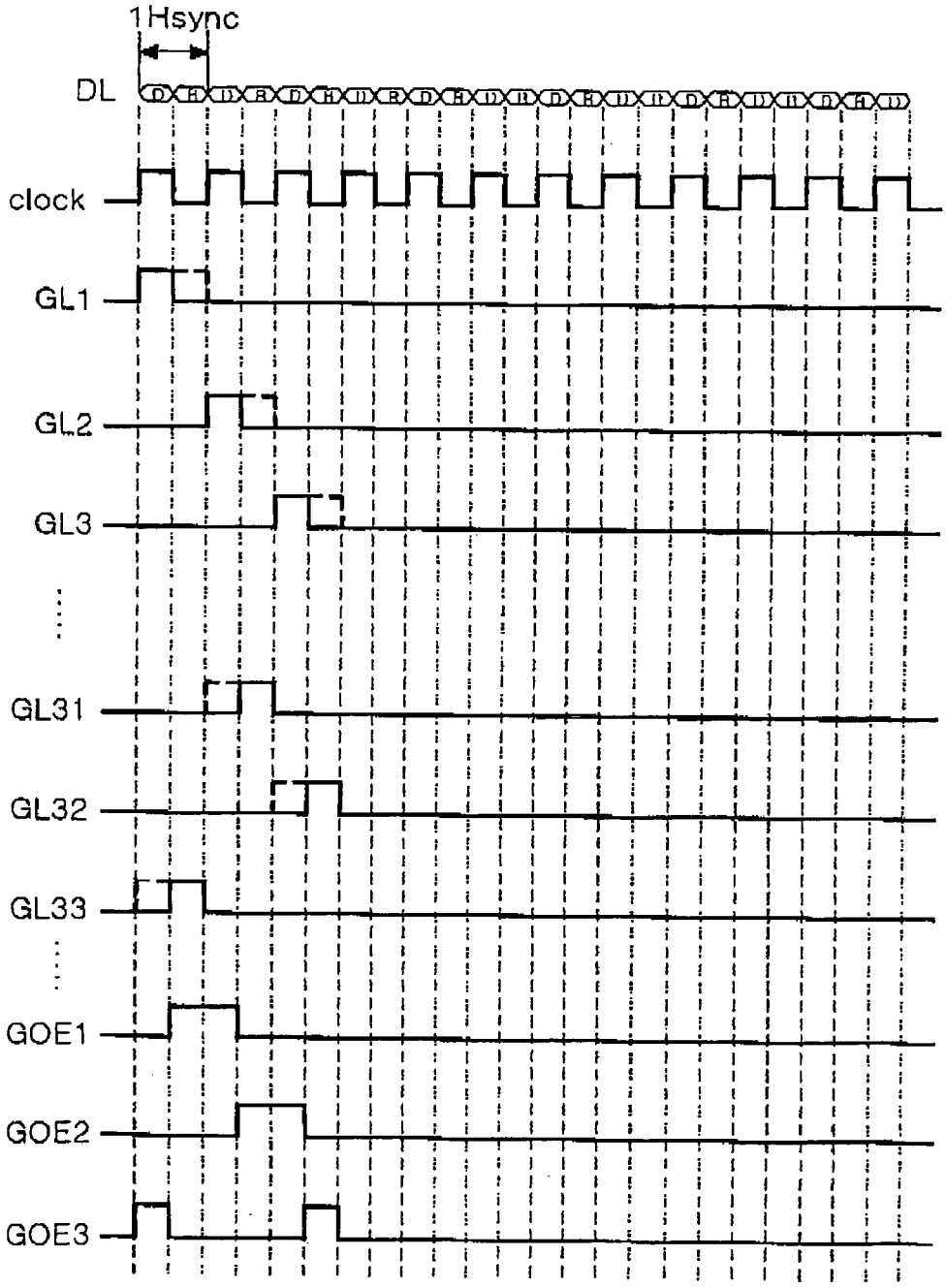
FIG. 11 shows driving waveforms of a gate driver and a data driver according to a second embodiment of the present invention.

FIG. 11 shows driving waveforms of the gate driver according to a second embodiment of the present invention. Referring to FIG. 11, the gate driver sequentially generates scanning pulses SP to be applied to the (3i+1)th, (3i+2)th and (3i+3)th gate lines GL in synchronization with a clock signal. When a scanning pulse SP is applied to the (3i+1)th gate line GL1 (and subsequently to GL4, GL7, . . . ), the scanning pulse SP also is applied to the (3i+33)th gate line GL33 (and subsequently to GL36, GL39, . . . ) separated by a specified desired number of lines (32 lines in this case). Also, when a scanning pulse SP is applied to the (3i+2)th gate line GL2 (and subsequently to GL5, GL8, . . . ), the scanning pulse SP also is applied to the (3i+31)th gate line GL31 (and subsequently to GL34, GL37, . . . ) separated by a desired specified number of lines (29 lines in this case). Furthermore, when a scanning pulse SP is applied to the (3i+3)th gate line GL3 (and subsequently to GL6, GL9, . . . ), the scanning pulse SP also is applied to the (3i+32)th gate line GL32 (and subsequently, to GL35, 38, . . . ) separated by a desired specified number of lines (29 in this case).

When a scanning pulse SP is applied to the (3i+1)th gate line GL1 (and subsequently to GL4, GL7, . . . ), the first gate output enable signal GOE1 is set to a high state during a half period of a clock signal (e.g., during the second half period of the clock signal when the clock signal has a low state, as shown in FIG. 11). Further, when a scanning pulse SP is applied to the (3i+33)th gate line GL33 (and subsequently to GL6, GL9, . . . ) in synchronization with the scanning pulse SP applied to the (3i+1)th gate line GL1 (and subsequently to GL4, GL7, . . . ), the third gate output enable signal GOE3 is set at a high state during the other half period of the clock signal (e.g., during the first half period of the clock signal when the clock signal has a high state, as shown in FIG. 11).

When a scanning pulse SP is applied to the (3i+2)th gate line GL2 (and subsequently to GL5, GL8, . . . ), the second gate output enable signal GOE2 is set at a high state during a half period of the clock signal (e.g., during the second half period of the clock signal when the clock signal has a low state, as shown in FIG. 11). Further, when a scanning pulse SP is applied to the (3i+31)th gate line GL31 (and subsequently to GL34, GL37, . . . ) in synchronization with the scanning pulse SP applied to the (3i+2)th gate line GL2 (and subsequently to GL5, GL8, . . . ), the first gate output enable signal GOE1 remains at a high state during the other half period of the clock signal (e.g., during the first half period of the clock signal when the clock signal has a high state, as shown in FIG. 11).

When a scanning pulse SP is applied to the (3i+3)th gate line GL3 (and subsequently to GL6, GL9, . . . ), the third gate output enable signal GOE3 is set at a high state during a half period of a clock signal (e.g., during the second half period of the clock signal when the clock signal has a low state, as shown in FIG. 11). Further, when a scanning pulse SP is applied to the (3i+32)th gate line GL32 (and subsequently to GL35, GL38, . . . ) in synchronization with the scanning pulse SP applied to the (3i+3)th gate line GL3 (and subsequently to GL6, GL9, . . . ), the second gate output enable signal GOE2 remains at a high state during the other half period of the clock signal (e.g., during the first half period of the clock signal when the clock signal has a high state, as shown in FIG. 11).

In the second embodiment of the present invention, a scanning pulse SP, which originally spans from the leading edge of one clock to the leading edge of the next clock, is split into two scanning pulses by utilizing the first to third gate output enable signals GOE1 to GOE3, and the split scanning pulses are respectively applied to two gate lines GL separated by a specified number of lines during one period of the clock signal. Also, a picture data D is supplied in synchronization with one of the two scanning pulses SP applied during one period of the clock signal while a reset data R is supplied in synchronization with the other scanning pulse SP.

As described above, according to the present invention, two gate lines are scanned as a pair within one clock cycle in one frame, and a black data is supplied when one of the two gate lines is scanned while a picture data is supplied when the remaining one of the two gate lines is scanned. Accordingly, a desired picture is always displayed over the black picture, and it becomes possible to prevent a motion blur phenomenon. Also, it becomes possible to predict and determine a capacitance value of the liquid crystal cell. Once the capacitance value of the liquid crystal cell is determined, a voltage drop amount of the data pulse can be determined whereby it becomes possible to compensate the voltage drop amount of the data pulse.

It will be apparent to those skilled in the art that various modifications and variations can be made in the driving method for liquid crystal display and the liquid crystal display device of the present invention without departing from the spirit or scope of the invention. Thus, it is intended that the present invention cover the modifications and variations of this invention provided they come within the scope of the appended claims and their equivalents.

What is claimed is:

1. A method of driving a liquid crystal display including a liquid crystal display panel having pixels arranged in a matrix form, a gate driver for applying a scanning signal to gate lines of the liquid crystal display panel, and a data driver for supplying a picture data to data lines of the liquid crystal display panel, the method comprising the steps of:

applying a clock pulse to the gate driver;

applying first to third gate output enable signals to the gate driver; and applying a scanning pulse to two gate lines during one period of the clock pulse, wherein the data driver supplies the picture data to the data lines when the scanning pulse is applied to a first gate line of the two gate lines, and supplies a black data to the data lines when the scanning pulse is applied to a second gate line of the two gate lines.

2. The method according to claim 1, wherein applying the scanning pulse to two gate lines during one period of the clock pulse is based on the first to third gate output enable signals.

3. A method of driving a liquid crystal display including a liquid crystal display panel having pixels arranged in a matrix form, a gate driver for applying a scanning signal to gate lines of the liquid crystal display panel, and a data driver for supplying a picture data to data lines of the liquid crystal display panel, the method comprising the steps of:

applying a clock pulse to the gate driver;

applying first to third gate output enable signals to the gate driver; and applying a scanning pulse to two gate lines during one period of the clock pulse, wherein the data driver supplies a black data to the data lines when the scanning pulse is applied to a first gate line of the two gate lines, and supplies the picture data to the data lines when the scanning pulse is applied to a second gate line of the two gate lines.

4. The method according to claim 3, wherein applying the scanning pulse to two gate lines during one period of the clock pulse is based on the first to third gate output enable signals.

5. A method of driving a liquid crystal display including a liquid crystal display panel having pixels arranged in a matrix form, a gate driver for applying a scanning signal to gate lines of the liquid crystal display panel, and a data driver for supplying a picture data to data lines of the liquid crystal display panel, the method comprising the steps of:

applying a clock pulse to the gate driver;

applying a scanning pulse to two gate lines during one period of the clock pulse, which includes:

applying the scanning pulse to the (3i+1)th gate line during one period of the clock signal; and applying the scanning pulse to the (3(i+k)+2)th gate line, which is thereby separated from the (3i+1)th gate line by 3k+1 gate lines, when the scanning pulse is applied to the (3i+1)th gate line, where k is a positive integer; and applying first to third gate output enable signals to the gate driver, which includes:

setting the first gate output enable signal at a high state during one half of the one period of the clock signal when the scanning pulse is applied to the (3i+1)th gate line; and setting the second gate output enable signal at a high state during the other half of the one period of the clock signal when the scanning pulse is applied to the (3(i+k)+2)th gate line, wherein the first gate output enable signal is applied to each of the (3i+1)th gate lines, the second gate output enable signal is applied to each of the (3i+2)th gate lines, and the third gate output enable signal is applied to each of the (3i+3)th gate lines, where i is a non-negative integer.

6. A method of driving a liquid crystal display including a liquid crystal display panel having pixels arranged in a matrix form, a gate driver for applying a scanning signal to gate lines of the liquid crystal display panel, and a data driver for supplying a picture data to data lines of the liquid crystal display panel, the method comprising the steps of:

applying a clock pulse to the gate driver;

applying a scanning pulse to two gate lines during one period of the clock pulse, which includes:

applying the scanning pulse to the (3i+2)th gate line during one period of the clock signal; and applying the scanning pulse to the (3(i+k)+3)th gate line, which is thereby separated from the (3i+2)th gate line by 3k+1 gate lines, when the scanning pulse is applied to the (3i+2)th gate line, where k is a positive integer; and applying first to third gate output enable signals to the gate driver, which includes:

setting the second gate output enable signal at a high state during one half of the one period of the clock signal when the scanning pulse is applied to the (3i+2)th gate line; and setting the third gate output enable signal at a high state during the other half of the one period of the clock signal when the scanning pulse is applied to the (3(i+k)+3)th gate line, wherein the first gate output enable signal is applied to each of the (3i+1)th gate lines, the second gate output enable signal is applied to each of the (3i+2)th gate lines, and the third gate output enable signal is applied to each of the (3i+3)th gate lines, where i is a non-negative integer.

7. A method of driving a liquid crystal display including a liquid crystal display panel having pixels arranged in a matrix form, a gate driver for applying a scanning signal to gate lines of the liquid crystal display panel, and a data driver for supplying a picture data to data lines of the liquid crystal display panel, the method comprising the steps of:

applying a clock pulse to the gate driver;

applying a scanning pulse to two gate lines during one period of the clock pulse, which includes:

applying the scanning pulse to the (3i+3)th gate line during one period of the clock signal; and applying the scanning pulse to the (3(i+k)+1)th gate line, which is thereby separated from the (3i+3)th gate line by 3k−2 gate lines, when the scanning pulse is applied to the (3i+3)th gate line, where k is a positive integer; and applying first to third gate output enable signals to the gate driver, which includes:

setting the third gate output enable signal at a high state during one half of the one period of the clock signal when the scanning pulse is applied to the (3i+3)th gate line; and setting the first gate output enable signal at a high state during the other half of the one period of the clock signal when the scanning pulse is applied to the (3(i+k)+1)th gate line, wherein the first gate output enable signal is applied to each of the (3i+1)th gate lines, the second gate output enable signal is applied to each of the (3i+2)th gate lines, and the third gate output enable signal is applied to each of the (3i+3)th gate lines, where i is a non-negative integer.

8. A method of driving a liquid crystal display including a liquid crystal display panel having pixels arranged in a matrix form, a gate driver for applying a scanning signal to gate lines of the liquid crystal display panel, and a data driver for supplying a picture data to data lines of the liquid crystal display panel, the method comprising the steps of:

applying a clock pulse to the gate driver;

applying a scanning pulse to two gate lines during one period of the clock pulse, which includes:

applying the scanning pulse to the (3i+1)th gate line during one period of the clock signal; and applying the scanning pulse to the (3(i+k)+3)th gate line, which is thereby separated from the (3i+1)th gate line by 3k+2 gate lines, when the scanning pulse is applied to the (3i+1)th gate line, where k is a positive integer; and applying first to third gate output enable signals to the gate driver, which includes:

setting the first gate output enable signal at a high state during one half of the one period of the clock signal when the scanning pulse is applied to the (3i+1)th gate line; and setting the third gate output enable signal at a high state during the other half of the one period of the clock signal when the scanning pulse is applied to the (3(i+k)+3)th gate line, wherein the first gate output enable signal is applied to each of the (3i+1)th gate lines, the second gate output enable signal is applied to each of the (3i+2)th gate lines, and the third gate output enable signal is applied to each of the (3i+3)th gate lines, where i is a non-negative integer.

9. A method of driving a liquid crystal display including a liquid crystal display panel having pixels arranged in a matrix form, a gate driver for applying a scanning signal to gate lines of the liquid crystal display panel, and a data driver for supplying a picture data to data lines of the liquid crystal display panel, the method comprising the steps of:

applying a clock pulse to the gate driver;

applying a scanning pulse to two gate lines during one period of the clock pulse, which includes:

applying the scanning pulse to the (3i+2)th gate line during one period of the clock signal; and applying the scanning pulse to the (3(i+k)+1)th gate line, which is thereby separated from the (3i+2)th gate line by 3k−1 gate lines, when the scanning pulse is applied to the (3i+2)th gate line, where k is a positive integer; and applying first to third gate output enable signals to the gate driver, which includes:

setting the second gate output enable signal at a high state during one half of the one period of the clock signal when the scanning pulse is applied to the (3i+2)th gate line; and setting the first gate output enable signal at a high state during the other half of the one period of the clock signal when the scanning pulse is applied to the (3(i+k)1)th gate line, wherein the first gate output enable signal is applied to each of the (3i+1)th gate lines, the second gate output enable signal is applied to each of the (3i+2)th gate lines, and the third gate output enable signal is applied to each of the (3i+3)th gate lines, where i is a non-negative integer.

10. A method of driving a liquid crystal display including a liquid crystal display panel having pixels arranged in a matrix form, a gate driver for applying a scanning signal to gate lines of the liquid crystal display panel, and a data driver for supplying a picture data to data lines of the liquid crystal display panel, the method comprising the steps of:

applying a clock pulse to the gate driver;

applying a scanning pulse to two gate lines during one period of the clock pulse, which includes:

applying the scanning pulse to the (3i+3)th gate line during one period of the clock signal; and applying the scanning pulse to the (3(i+k)+2)th gate line, which is thereby separated from the (3i+3)th gate line by 3k−1 gate lines, when the scanning pulse is applied to the (3i+3)th gate line, where k is a positive integer; and applying first to third gate output enable signals to the gate driver, which includes:

setting the third gate output enable signal at a high state during one half of the one period of the clock signal when the scanning pulse is applied to the (3i+3)th gate line; and setting the second gate output enable signal at a high state during the other half of the one period of the clock signal when the scanning pulse is applied to the (3(i+k)+2)th gate line, wherein the first gate output enable signal is applied to each of the (3i+1)th gate lines, the second gate output enable signal is applied to each of the (3i+2)th gate lines, and the third gate output enable signal is applied to each of the (3i+3)th gate lines, where i is a non-negative integer.

11. A method of driving a liquid crystal display that is driven frame by frame, comprising the steps of:

displaying a first picture on a liquid crystal display panel in a current frame;

displaying a specific dummy picture on the liquid crystal display panel on which said first picture has been displayed, wherein the specific dummy picture is selected based on one of first to third gate output enable signals; and displaying a second picture over said specific dummy picture in a next frame, wherein the second picture is selected based on another one of first to third gate output enable signals.

12. The method according to claim 11, wherein the specific dummy picture is a black picture.

13. A liquid crystal display device, comprising:

a liquid crystal display panel having a plurality of gate lines and a plurality of data lines arranged substantially in a matrix form;

a gate driver receiving a clock signal and connected to each of the plurality of gate lines, the gate driver internally and sequentially generating scanning pulses in synchronization with the clock signal, the gate driver receiving at least two gate output enable signals that respectively control different groups of the gate lines, wherein when a gate output enable signal is in an enabling state, the output of the scanning signal to the gate lines belonging to the corresponding group is enabled, and when a gate output enable signal is in a disable state, the output of the scanning signal to the gate lines belonging to the corresponding group is disabled, and wherein in one cycle of the clock signal, the gate driver generates a scanning pulse for a pair of gate lines that belong to different groups and processes the scanning pulse generated for the pair of gate lines with the corresponding gate output enable signals so as to divide the scanning pulse to two sequential pulses, the gate driver supplying one of the two sequential pulses to one of the pair of the gate lines and supplying the other one of the two sequential pulses to the other one of the pair of the gate lines; and a data driver connected to the plurality of data lines, the data driver supplying data signals to the plurality of data lines in synchronization with the one of the two sequential pulses, the data driver further supplying a reference signal to the plurality of data lines in synchronization with the other one of the two sequential pulses.

14. The liquid crystal display device according to claim 13, wherein the gate driver receives two gate output enable signals, and the gate lines are divided into two groups of odd numbered gate lines and even numbered gate lines, as numbered from the top to the bottom of the display panel.

15. The liquid crystal display device according to claim 14, wherein the reference signal is a black signal.

16. The liquid crystal display device according to claim 13, wherein the gate driver receives three gate output enable signals, and the gate lines are divided into three groups of (3i+1) numbered gate lines, (3i+2) numbered gate lines, and (3i+3) numbered gate lines, as numbered from the top to the bottom of the display panel, where i is a non-negative integer.

17. The liquid crystal display device according to claim 16, wherein the reference signal is a black signal.

18. A method for driving a liquid crystal display panel, comprising:

(a) selecting two gate lines that are separated by a predetermined number of gate lines based on received first to third gate output enable signals during one period of a clock pulse;

(b) providing picture signals to a row of pixels corresponding to one of the two selected gate lines;

(c) providing a reference signal to a row of pixels corresponding to the other one of the two selected gates lines;

(d) repeating steps (a) through (c) for different pairs of gate lines so that all rows of pixels are refreshed by corresponding picture signals in one frame; and (e) repeating steps (a) through (d) for each frame so that updated picture signals are provided to the pixels that bear the reference signal immediately prior to being updated.

19. The method according to claim 18, wherein the reference signal is the same for all rows of pixels and for each frame.

20. The method according to claim 19, wherein the reference signal is such that each pixel provided with the reference signal exhibits a black dot.

21. The method according to claim 18, wherein steps (a) through (d) are performed such that a horizontal band of pixels applied with the reference signal sweeps an entire screen of the liquid crystal display panel from the top to the bottom in each frame.

22. The method according to claim 21, wherein the horizontal band is a black band.

* * * * *